US007033166B2

(12) United States Patent
Hsu

(10) Patent No.: US 7,033,166 B2
(45) Date of Patent: Apr. 25, 2006

(54) VALVE HAVING MECHANISM FOR DIVERTING REVERSE GAS FLOW

(76) Inventor: Huang-Hsi Hsu, 8F. No. 14, Lane 252, Chungshan N. Rd., Sec. 6, Taipei (TW)

( * ) Notice: Subject to any disclaimer, the term of this patent is extended or adjusted under 35 U.S.C. 154(b) by 157 days.

(21) Appl. No.: 10/847,870

(22) Filed: May 19, 2004

(65) Prior Publication Data

US 2005/0260531 A1 Nov. 24, 2005

(51) Int. Cl.
*F23D 14/28* (2006.01)

(52) U.S. Cl. ..... 431/344; 431/346; 431/153; 137/625.26

(58) Field of Classification Search ..... 431/344, 431/346, 153, 255, 277; 137/625.26, 625.27
See application file for complete search history.

(56) References Cited

U.S. PATENT DOCUMENTS 4,251,226 A * 2/1981 Nishikawa ..... 48/192
5,407,348 A * 4/1995 Mims et al. ..... 431/346
5,735,684 A * 4/1998 Tsai ..... 431/242
6,171,098 B1 * 1/2001 Meyer et al. ..... 431/72
6,884,063 B1 * 4/2005 Wong ..... 431/255

* cited by examiner

*Primary Examiner*—Alfred Basichas
(74) *Attorney, Agent, or Firm*—Bacon & Thomas, PLLC

(57) ABSTRACT

The present invention is to provide a valve with a safety mechanism for diverting reverse gas flow being mountable in a gas lighter wherein a shoulder is formed around a mouth proximate a forward opening of a sleeve and is spaced apart from the forward opening by a predetermined gap when an actuation member is not pressed, the actuation member is pressed to lift a leakproof nut at a bottom of the mouth for opening a bottom hole of a seat to permit gas to flow into the valve, the shoulder then contacts the forward opening for blocking gas flow and direct the gas flow to a nozzle through a hose for ignition. Thus, after the actuation member being released, the gas remaining in the hose will flow back and leak through the gap and the forward opening to the outside because the gas pressure in the hose is larger than the outside pressure.

5 Claims, 5 Drawing Sheets

VALVE HAVING MECHANISM FOR DIVERTING REVERSE GAS FLOW

FIELD OF THE INVENTION

The present invention relates to valves of a gas lighter and more particularly to a gas lighter including a valve having a safety mechanism for diverting reverse gas flow when the gas lighter is deactivated.

BACKGROUND OF THE INVENTION

A conventional gas lighter (e.g., pressure actuation gas lighter) is shown in FIGS. 1 and 2. The gas lighter comprises an elongated handle 10 including a hollow cylinder 11 extended outwardly a predetermined distance, the cylinder 11 including a nozzle 12 having one end 121 with a large diameter abutted on the cylinder 11, and the other end 122 with a small diameter open to outside. Within the handle 10 there are provided a gas fuel reservoir 13 having one end in fluid communication with a valve 14. The valve 14 comprises a hollow seat 141, a sleeve 142 having outer threads put on a forward portion of the seat 141, an elongated mouth 143 extended from a bottom of the seat 141 through the bore of the sleeve 142 and a forward opening 144, and an enlargement 145 formed on a forward end of the mouth 143 and inserted into a hose 151. An actuation member 15 is pivotably provided between the enlargement 145 and the sleeve 142 with the mouth 143 passed.

A peripheral projection 146 is formed around the mouth 143 inside the sleeve 142. A spring 148 is put on the mouth 143 to be in contact with the projection 146. A gasket 147 is also put on the mouth 143 to be in contact with one end of the spring 148. Both spring 148 and gasket 147 are disposed within the sleeve 142. A side aperture 149 is formed on the mouth 143 adjacent the seat 141. A leakproof nut 16 is provided at the bottom of the mouth 143 proximate a bottom of the seat 141.

As shown in FIG. 2, pressing the actuation member 15 will lift the enlargement 145 from the leakproof nut 16 at the bottom of the mouth 143 and thus open a hole at the bottom of the seat 141. Next, gas may flow from the gas fuel reservoir 13 to the cylinder 11 (i.e., the nozzle 12) through the hose 151 as indicated by arrows. As an end, a lighting tube (not shown) is activated to burn as gas flows to it.

However, the prior art suffered from a disadvantage. For example, the gas lighter may still burn after cutting off the gas supply path. In detail, after something has been burned by igniting the gas lighter a user may release the actuation member 15 to lower the mouth 143 to its normal position. At this time, it is supposed that gas will not flow from the gas fuel reservoir 13 to the nozzle 12. However, this is not true. As shown in FIG. 1, a releasing of the actuation member 15 will lower the mouth 143 to its normal position and thus cause the leakproof nut 16 at the bottom of the mouth 143 to block the gas path at the bottom of the seat 141 (i.e., stop gas from flowing out of the gas fuel reservoir 13). But the gasket 147 adjacent the forward opening 144 inside the sleeve 142 still blocks the forward opening 144 because the gasket 147 is urged by the elasticity of the spring 148. As such, remaining gas in the hose 151 cannot flow back due to insufficient momentum and pressure. Instead, remaining gas continues to flow along the hose 151 to the nozzle 12. That is, remaining gas will continue to flow to the nozzle 12 in the cylinder 11 since gas pressure in the hose 151 is larger than outside pressure (i.e., atmospheric pressure). Such flow will finally stop when gas pressure in the hose 151 drops below the atmospheric pressure. The above has described the reason why the gas lighter still burns after cutting off the gas supply path. Unfortunately, it may result in fires causing property damage and injury to people. Hence, a need for improvement exists.

SUMMARY OF THE INVENTION

A primary object of the present invention is to provide a valve mounted in a gas lighter. The valve has a safety mechanism for diverting reverse gas flow when the gas lighter is deactivated. By utilizing the present invention, the above drawback of the prior art can be overcome. The drawback is that remaining gas in the gas lighter still burns after cutting off the gas supply path, resulting in fires causing property damage and injury to people.

One object of the present invention is to provide a valve with a safety mechanism for diverting reverse gas flow being mountable in a gas lighter wherein a shoulder is formed around a mouth proximate a forward opening of a sleeve having outer threads, the shoulder is spaced apart from the forward opening of the sleeve by a predetermined gap when an actuation member is not pressed, the actuation member is pressed to lift a leakproof nut at a bottom of the mouth for opening a bottom hole of a seat to permit gas to flow into the valve, the shoulder of the mouth then contacts the forward opening of the sleeve for blocking gas flow, and gas flows to a nozzle through a hose for ignition. To the contrary, after something has been burned by igniting the gas lighter a user may release the actuation member to lower the mouth to its normal position as expansion of a spring, the bottom hole of the seat is blocked by the leakproof nut at the bottom of the mouth for blocking gas flow, the shoulder of the mouth is still spaced apart from the forward opening of the sleeve by the predetermined gap, the gas remaining in the hose will flow back and then leak through the gap and the forward opening of the sleeve to the outside because the gas pressure in the hose is larger than the outside pressure. The present invention is thus able to achieve the purposes of quickly ceasing the burning of the gas lighter after cutting off the gas supply path and preventing fires from occurring.

The above and other objects, features and advantages of the present invention will become apparent from the following detailed description taken with the accompanying drawings.

DETAILED DESCRIPTION OF THE PREFERRED EMBODIMENTS

Figure 1:
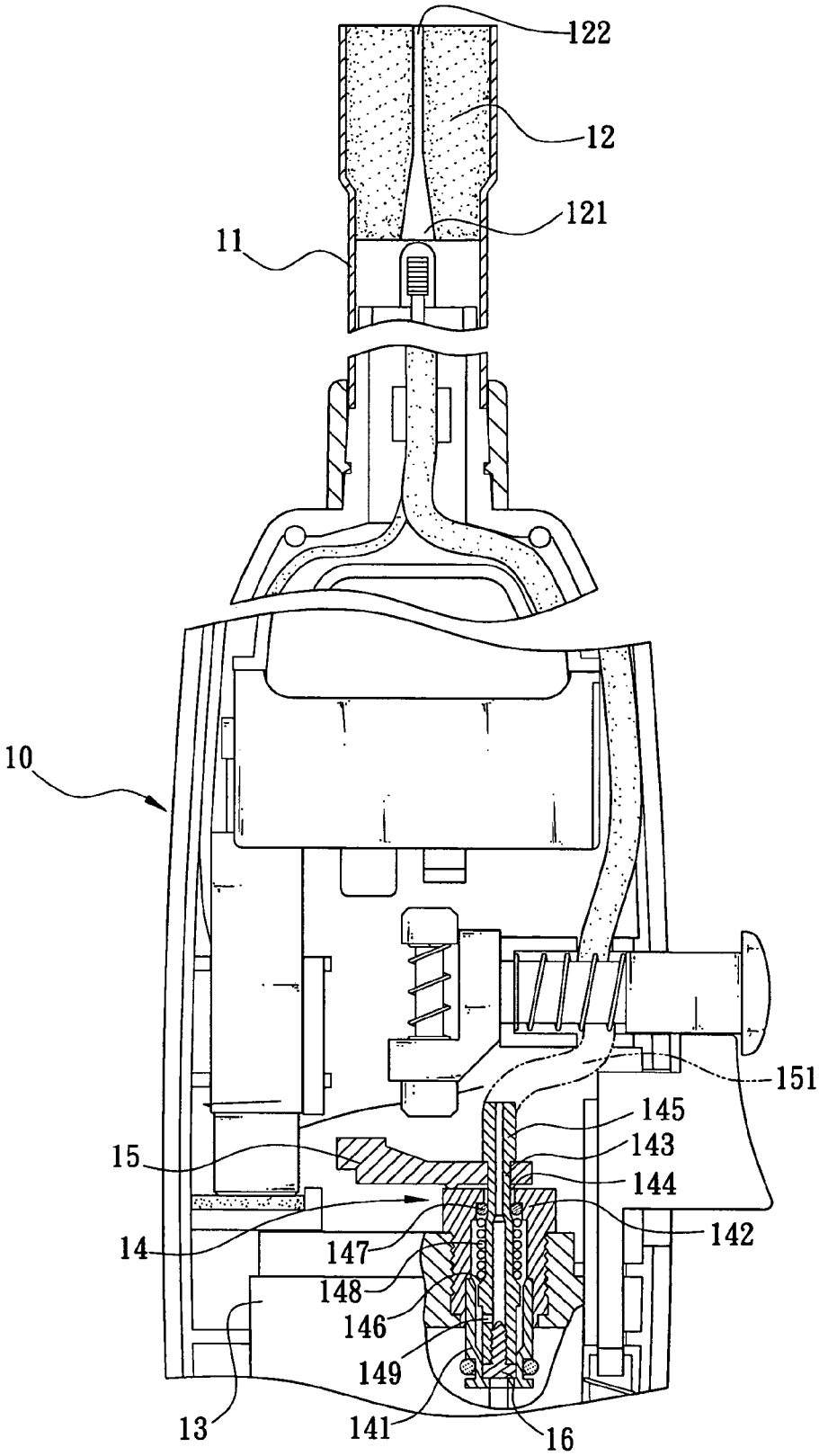
FIG. 1 (Prior Art)
FIG. 1 is a broken apart interior view in part section of a conventional gas lighter.
Figure 2:
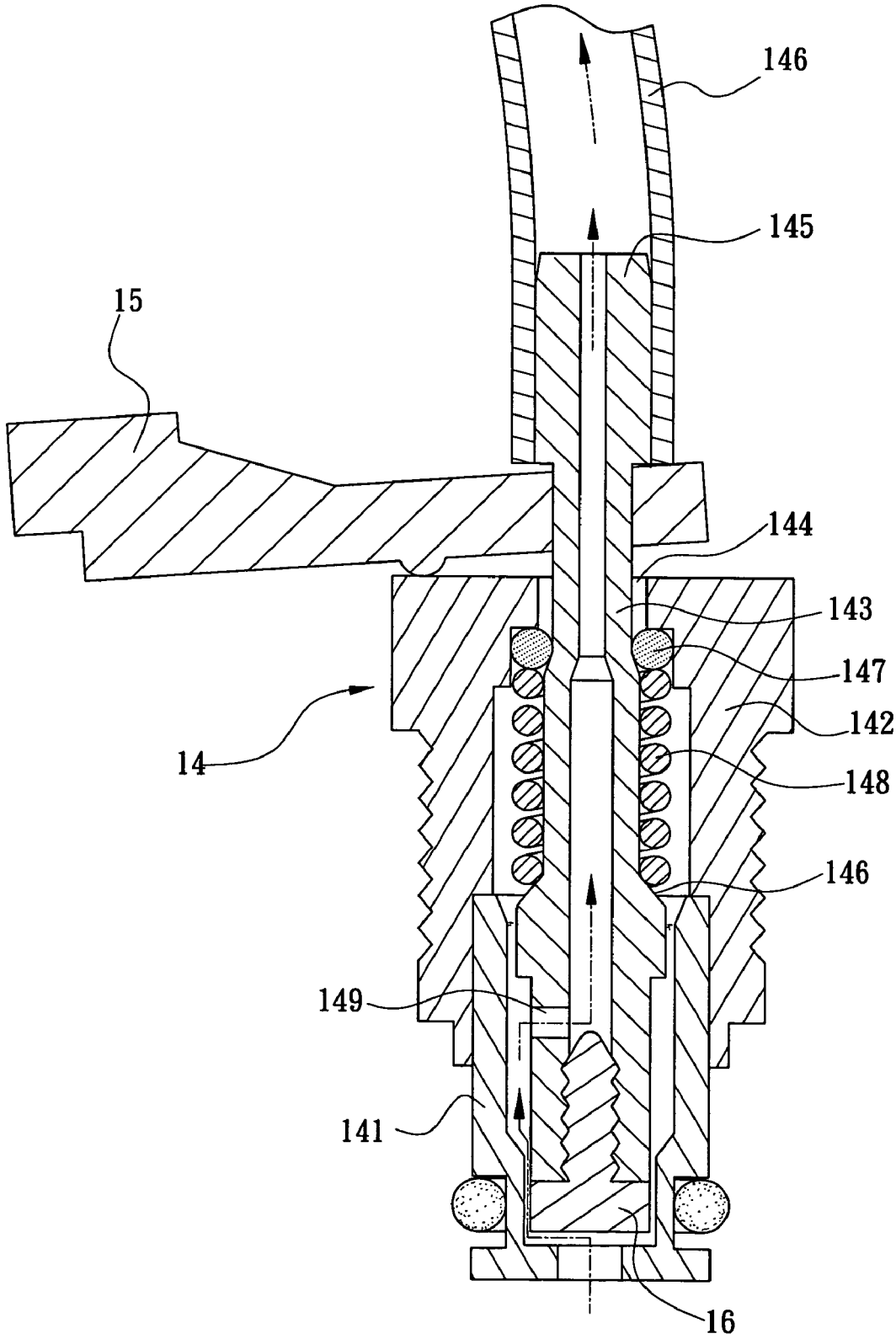
FIG. 2 (Prior Art)
FIG. 2 is a greatly enlarged, sectional view of the valve in FIG. 1 in an activated state.
Figure 3:
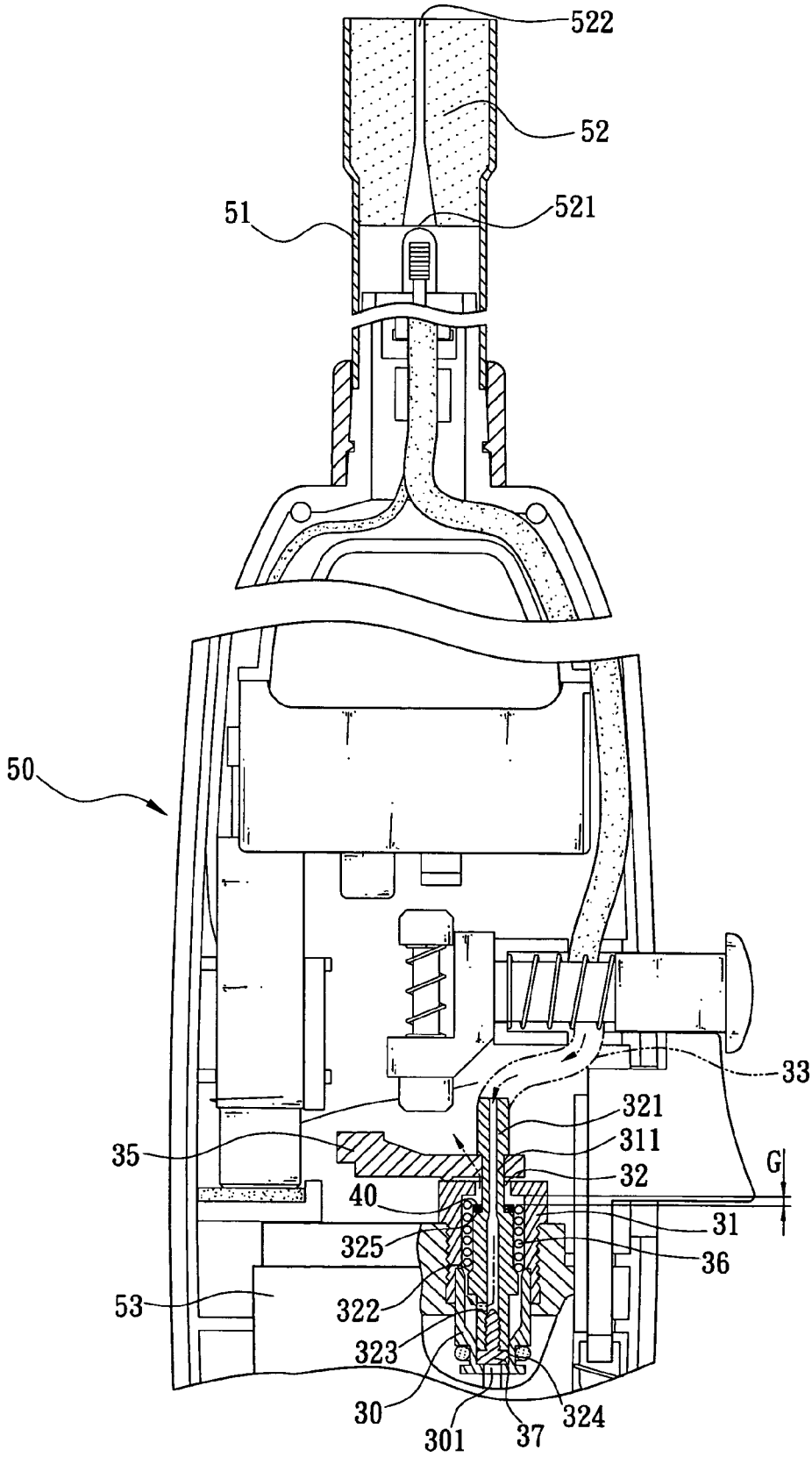
FIG. 3 is a broken apart interior view in part section of a gas lighter according to a preferred embodiment of the invention.

The invention is directed to a valve of a gas lighter (e.g., a pressure actuation as implemented in a preferred embodiment of the invention or a well known gas lighter) having a safety mechanism for diverting reverse gas flow when the gas lighter is deactivated. Referring to FIG. 3, the gas lighter comprises an elongated handle 50 including a hollow cylinder 51 extended outwardly a predetermined distance, the cylinder 51 including a nozzle 52 having one end 521 with a large diameter abutted on the cylinder 51, and the other end 522 with a small diameter open to outside. Within the handle 50 there are provided the valve of the invention, and a gas fuel reservoir 53 having one end in fluid communication with the valve.

The valve of the invention comprises a hollow seat 30 including a bottom hole 301 for permitting gas to flow from the gas fuel reservoir 53 into the seat 30, a sleeve 31 having outer threads put on a forward portion of the seat 30, an elongated mouth 32 extended from a position near the bottom hole 301 of the seat 30 through the bore of the sleeve 31 and a forward opening 311 of the sleeve 31, and an enlargement 321 formed on a forward end of the mouth 32 (i.e., outside the forward opening 311 of the sleeve 31) and inserted into a hose 33. An actuation member 35 is pivotably provided between the enlargement 321 and the sleeve 31 with the mouth 32 passed.

In the invention, a peripheral projection 322 having a predetermined length is formed around the mouth 32 inside the sleeve 31. A spring 36 is put on the mouth 32 to be in contact with the projection 322. That is, both ends of the spring 36 are urged against the projection 322 and an inner wall adjacent the forward opening 311 of the sleeve 31 respectively. A side aperture 323 is formed on the mouth 32 adjacent the seat 30. A leakproof nut 37 is provided at the bottom 324 of the mouth 32 proximate the bottom hole 301 of the seat 30.

The characteristics of the valve of the invention are detailed below. A shoulder 325 is formed around the mouth 32 proximate the forward opening 311 of the sleeve 31. The shoulder 325 is spaced apart from the forward opening 311 of the sleeve 31 by a predetermined gap G when the actuation member 35 is not pressed.

Figure 4:
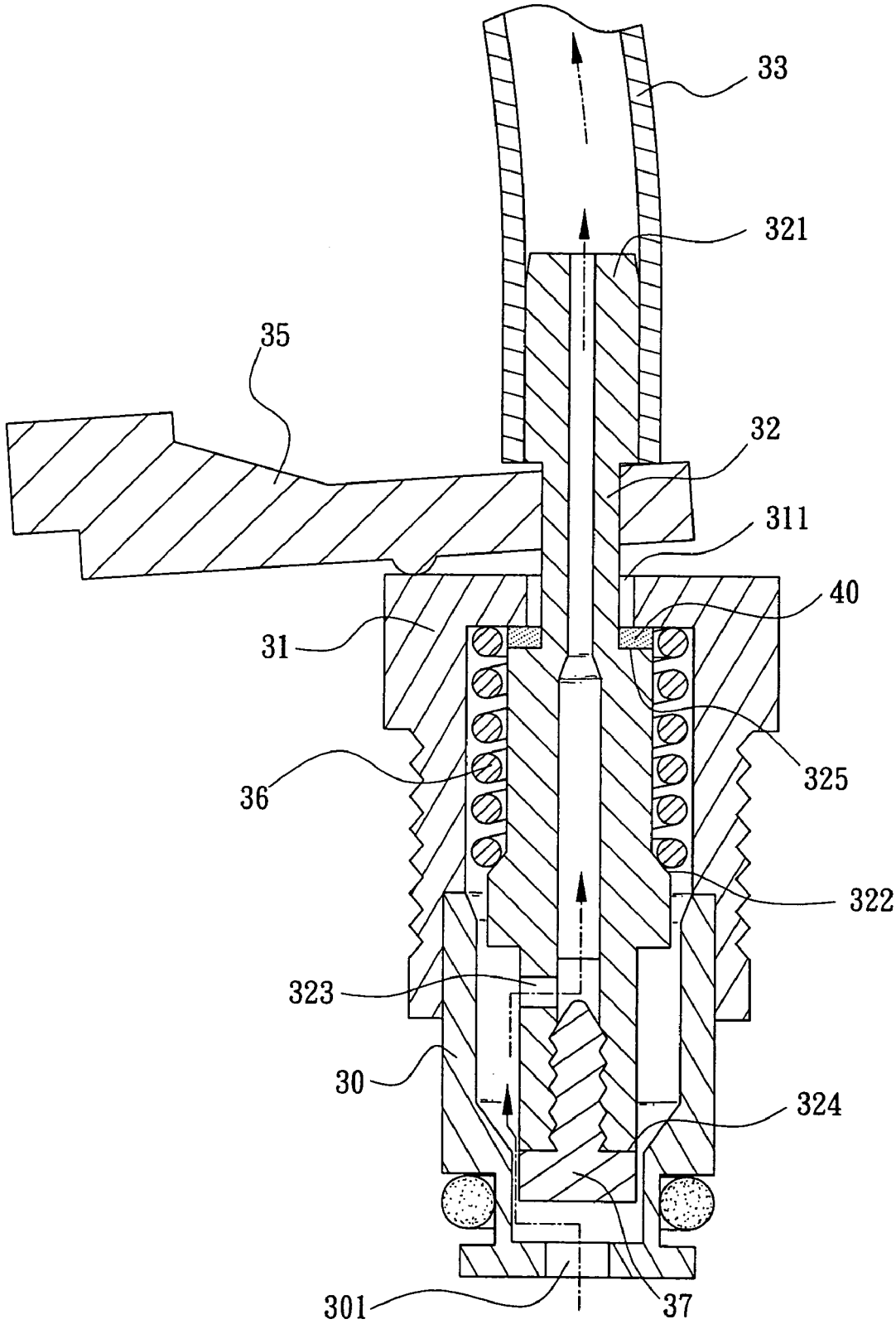
FIG. 4 is a greatly enlarged, sectional view of the valve in FIG. 3 in an activated state.

Referring to FIG. 4, when the actuation member 35 is pressed the enlargement 321 lifts and thus the leakproof nut 37 at the bottom of the mouth 32 lifts and thus open the bottom hole 301 of the seat 30. Also, the shoulder 325 of the mouth 32 contacts the forward opening 311 of the sleeve 31 for blocking the gas path. Thus, gas may flow from the aperture 323 of the mouth 32 to the cylinder 51 (i.e., the nozzle 52) through the hose 33 as indicated by arrows. As an end, a lighting tube (not shown) is activated to burn as gas flows to it.

Referring to FIG. 3 again, after something has been burned by igniting the gas lighter of the invention a user may release the actuation member 35 to lower the mouth 32 to its normal position as expansion of the spring 36. Also, the bottom hole 301 of the seat 30 is blocked by the leakproof nut 37 at the bottom of the mouth 32 (i.e., gas path is blocked). Further, the shoulder 325 of the mouth 32 is still spaced apart from the forward opening 311 of the sleeve 31 by the predetermined gap G. As such, the gas remaining in the hose 33 will flow back as indicated by arrows because the gas pressure in the hose 33 is larger than the outside pressure (i.e., atmospheric pressure). Finally, the gas leaks through the gap G and the forward opening 311 of the sleeve 31 to the outside. This can achieve the purpose of quickly ceasing the burning of the gas lighter after cutting off the gas supply path.

Referring to FIGS. 3 and 4 again, a gasket 40 is put on the shoulder 325 of the mouth 32. The gasket 40 is spaced apart from the forward opening 311 of the sleeve 31 by the predetermined gap G when the actuation member 35 is not pressed.

Figure 5:
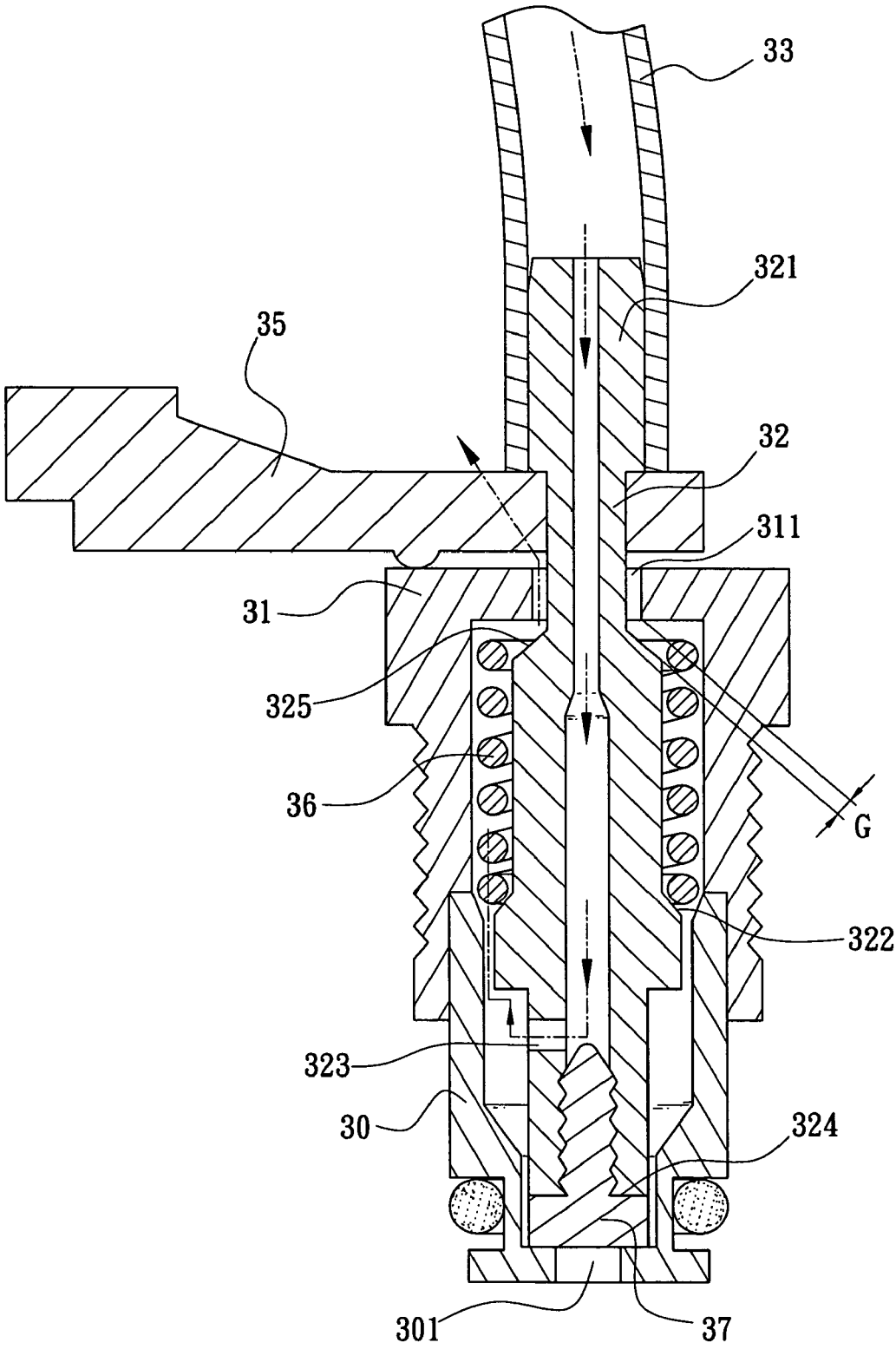
FIG. 5 is a view similar to FIG. 4 where a valve according to another preferred embodiment of the invention is in a deactivated state.

Referring to FIG. 5 in conjunction with FIG. 3, a valve according to another preferred embodiment of the invention is shown in a deactivated state. In detail, the shoulder 325 of the mouth 32 is slanted. Also, the shoulder 325 of the mouth 32 is spaced apart from the forward opening 311 of the sleeve 31 by the predetermined gap G when the actuation member 35 is not pressed.

In brief, the shoulder 325 of the mouth 32 is spaced apart from the forward opening 311 of the sleeve 31 by the predetermined gap G when the actuation member 35 is pressed. As such, gas may flow into the valve. At the same time, a small amount of gas may leak through the gap G. Advantageously, the gas path through the forward opening 311 of the sleeve 31 is immediately blocked due to the contact of the shoulder 325 of the mouth 32 with the forward opening 311 of the sleeve 31. Thus, the invention can solve the problem as experienced by prior art (i.e., the gas lighter still burns after cutting off the gas supply path and results in fires causing property damage and injury to people). In view of this, such small leaking from the gap G is allowable. Note that the valve of the invention is adapted to install in one of a variety of gas lighters sold in commerce.

While the invention has been described by means of specific embodiments, numerous modifications and variations could be made thereto by those skilled in the art without departing from the scope and spirit of the invention set forth in the claims.

What is claimed is:

1. A valve with a safety mechanism for diverting reverse gas flow being mountable in a gas lighter, comprising:

a hollow seat including a bottom hole for permitting gas to flow into;

a sleeve having outer threads put on a forward portion of the seat, the sleeve having a forward opening;

an elongated mouth extended from a position near the bottom hole of the seat through a bore of the sleeve and the forward opening of the sleeve, the mouth including an enlargement formed on a forward end outside the forward opening of the sleeve, a peripheral projection having a predetermined length formed inside the sleeve, a spring put thereon to be in contact with the projection so that both ends of the spring are urged against the projection and an inner wall adjacent the forward opening of the sleeve respectively, and a side aperture formed thereon adjacent the seat;

a leakproof nut disposed at a bottom of the mouth proximate the bottom hole of the seat;

a hose coupled to and in fluid communication with the enlargement and the sleeve; and an actuation member pivotably disposed between the enlargement and the sleeve with the mouth passed, wherein a shoulder is formed around the mouth proximate the forward opening of the sleeve, the shoulder being spaced apart from the forward opening of the sleeve by a predetermined gap when the actuation member is not pressed.

2. The valve of claim 1, further comprising a gasket put on the shoulder of the mouth, the gasket being spaced apart from the forward opening of the sleeve by the predetermined gap when the actuation member is not pressed.

3. The valve of claim 1, wherein the shoulder of the mouth is slanted so as to be spaced apart from the forward opening of the sleeve by the predetermined gap when the actuation member is not pressed.

4. The valve of claim 1, wherein the gas lighter is a pressure actuation gas lighter and comprises an elongated handle including a hollow cylinder extended outwardly a predetermined distance, the cylinder including a nozzle having one end with a first diameter abutted on the cylinder, and the other end with a second diameter smaller than the first diameter, and a gas fuel reservoir in the handle, the gas fuel reservoir having one end in fluid communication with the bottom hole of the seat.

5. The valve of claim 1, wherein the gas lighter is a conventional gas lighter and comprises an elongated handle including a hollow cylinder extended outwardly a predetermined distance, and a gas fuel reservoir in the handle, the gas fuel reservoir having one end in fluid communication with the bottom hole of the seat.

* * * * *